US006364694B1

(12) United States Patent
Lien

(10) Patent No.: US 6,364,694 B1
(45) Date of Patent: Apr. 2, 2002

(54) MODULAR COMMUNICATIONS SOCKET

(75) Inventor: Mei-Chia Lien, Taipei Hsien (TW)

(73) Assignee: M M E Corporation, Taipei Hsien (TW)

( * ) Notice: Subject to any disclaimer, the term of this patent is extended or adjusted under 35 U.S.C. 154(b) by 0 days.

(21) Appl. No.: 09/809,170

(22) Filed: Mar. 16, 2001

(30) Foreign Application Priority Data

Jan. 19, 2001 (TW) ..... 090201170

(51) Int. Cl.[7] ..... H01R 13/71
(52) U.S. Cl. ..... 439/489; 439/188; 439/676
(58) Field of Search ..... 439/607, 609, 439/188, 488, 489, 676

(56) References Cited

U.S. PATENT DOCUMENTS 5,470,251 A * 11/1995 Sano ..... 439/489
5,562,489 A * 10/1996 Saijo et al. ..... 439/489
6,135,809 A * 10/2000 Asakawa ..... 439/489
6,149,464 A * 11/2000 De Bauche et al. ..... 439/609

* cited by examiner

*Primary Examiner*—Hien Vu
(74) *Attorney, Agent, or Firm*—Jones, Tullar & Cooper, P.C.

(57) ABSTRACT

A socket has a body, an enlarged pin, a detecting pin and multiple contact pins. The enlarged pin and the detecting pin are separately secured in the body. The contact pins are secured in the cavity of the body in a row between the enlarged pin and the detecting pin. The enlarged pin is longer than each contact pin so that an enlarged section is formed on the enlarged pin. A lateral rod is formed on the detecting pin and extends to a position below the enlarge section of the enlarged pin. Consequently, the socket can automatically indicate whether a plug inserted into the socket is a cable plug or a telephone plug. The socket can be used with different types of modular communications plugs. The cost for manufacturing the computer or a modem that can accommodate different transmission media is reduced.

4 Claims, 4 Drawing Sheets

MODULAR COMMUNICATIONS SOCKET

BACKGROUND OF THE INVENTION

1. Field of the Invention

The present invention relates to a communications socket, and more particularly to a modular communications socket that can be used with different types of modular communications plugs.

2. Description of Related Art

A modular socket into which a modular communications plug can be inserted is always installed in a modem or a computer to transmit data between computers. With reference to FIG. 4, a conventional modular communications socket in accordance with the prior art comprises body (50) and multiple pins (52). A cavity is defined in one side of the body (50) to receive a plug (60) connected to a telephone cord (62). The pins (52) are secured in the cavity of the body (50). Each pin (52) has a leg extending through the body (50) to connect with a contact on a circuit board. In general, the number of the pins (52) is 2, 4 or 6 and corresponds to the number of the pins on the plug (60). Consequently, the data can be transmitted between two computers through the telephone cord (62) after the plug (60) is inserted into the socket.

Because the speed of transmitting data through a telephone cord (62) is so slow, a cable which can transmit data more rapid than the conventional telephone cord (62) is provided. A conventional modular communication socket for a plug (80) connected to a cable (82) is shown in FIG. 5. The conventional modular communication socket comprises a body (70) and multiple pins (72). A cavity is defined in one side of the body (70) to receive the plug (80). The pins (72) are secured in the cavity of the body (70). Each pin (72) has a leg extending through the body (70) to connect with a contact on a circuit board. The number of the pins (72) is 8 and equals the number of the pins on the plug (80). Consequently, data can be transmitted between two computers through the cable (82) when the plug (80) is inserted into the socket.

Nowadays, a computer or a modem always has a modular socket for the telephone cord and a socket for the cable to allow data to be selectively transmitted through a telephone cord or a cable. However, because the conventional socket (50, 70) cannot distinguish what kind of plug (60, 80) is inserted, a plug (60) with a telephone cord (62) cannot be used to transmit data when the plug (60) is inserted into a socket (70) for a cable plug (80). Therefore, two sockets (50, 70) with different structures from each other must be mounted on the computer or the modem. The cost for manufacturing the computer or the modem that can accommodate a telephone cord and a cable is expensive.

To overcome the shortcomings, the present invention intends to provide an improved socket to mitigate or obviate the aforementioned problems.

SUMMARY OF THE INVENTION

The main objective of the invention is to provide an improved modular communications socket that can be used with different types of modular communications plugs. The modular communications socket has a body, an enlarged pin, a detecting pin and multiple contact pins. The enlarged pin and the detecting pin are separately secured in the body. The contact pins are secured in the cavity of the body in a row and between the enlarged pin and the detecting pin. The enlarged pin is longer than each contact pin, such that an enlarged section is formed on the enlarged pin. A lateral rod is formed on the detecting pin and extends to a position below the enlarge section of the enlarged pin. In such an arrangement, the socket can automatically detect whether the plug inserted into the socket is a cable plug or a telephone plug. The socket can be used with different types of modular communications plugs.

Other objects, advantages and novel features of the invention will become more apparent from the following detailed description when taken in conjunction with the accompanying drawings.

DETAILED DESCRIPTION OF PREFERRED EMBODIMENT

Figure 1:
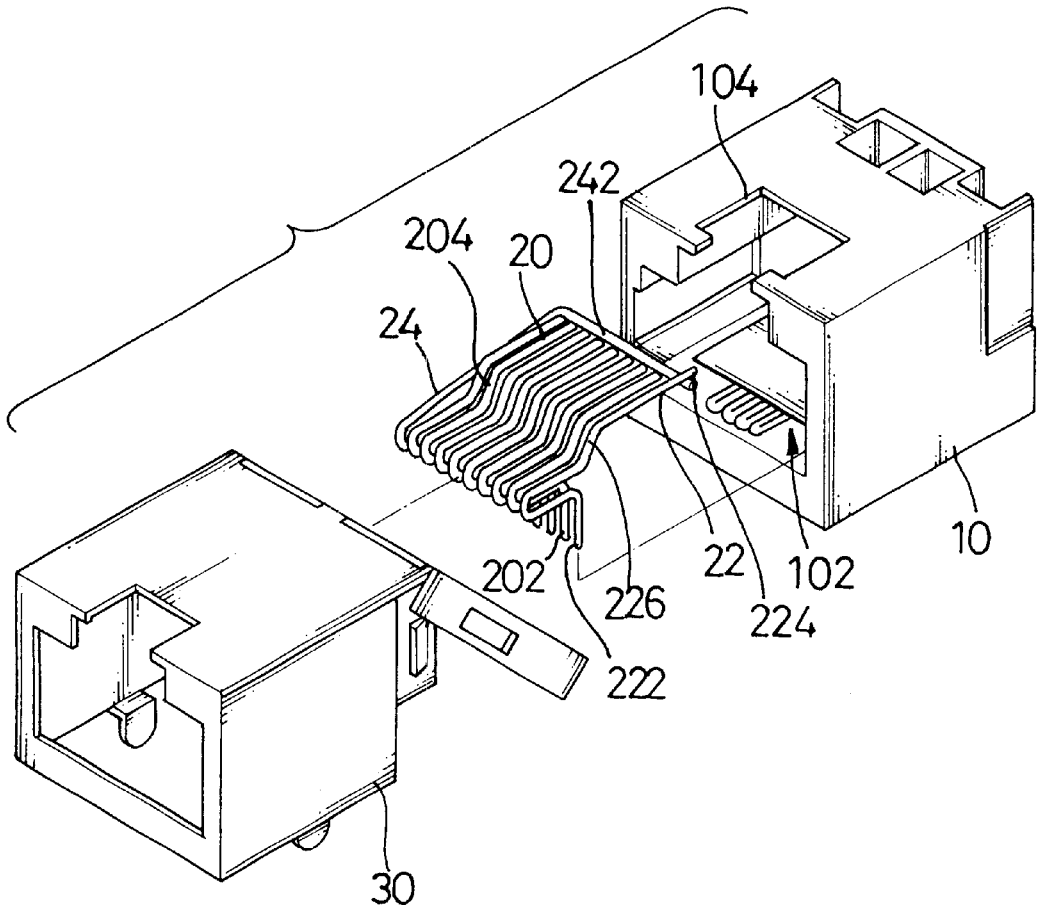
FIG. 1 is an exploded perspective view of a socket in accordance with the present invention.
Figure 2:
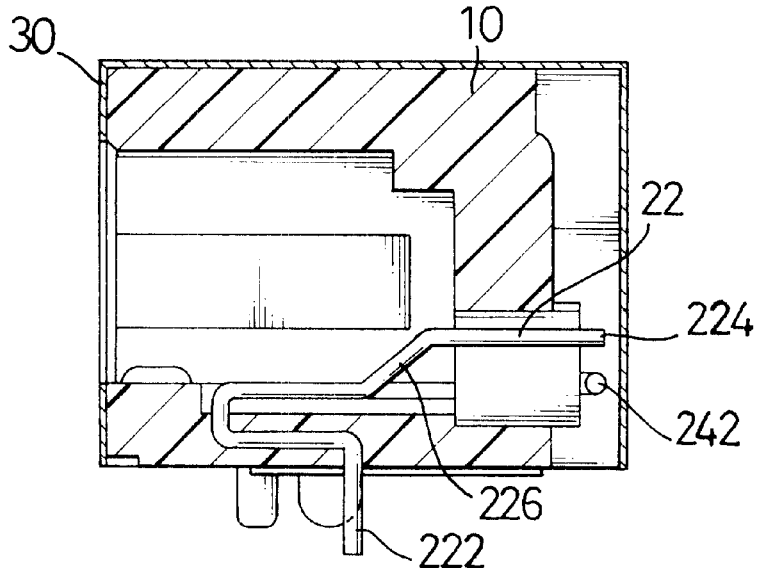
FIG. 2 is a side plan view in partial section of the socket in FIG. 1.
Figure 3:
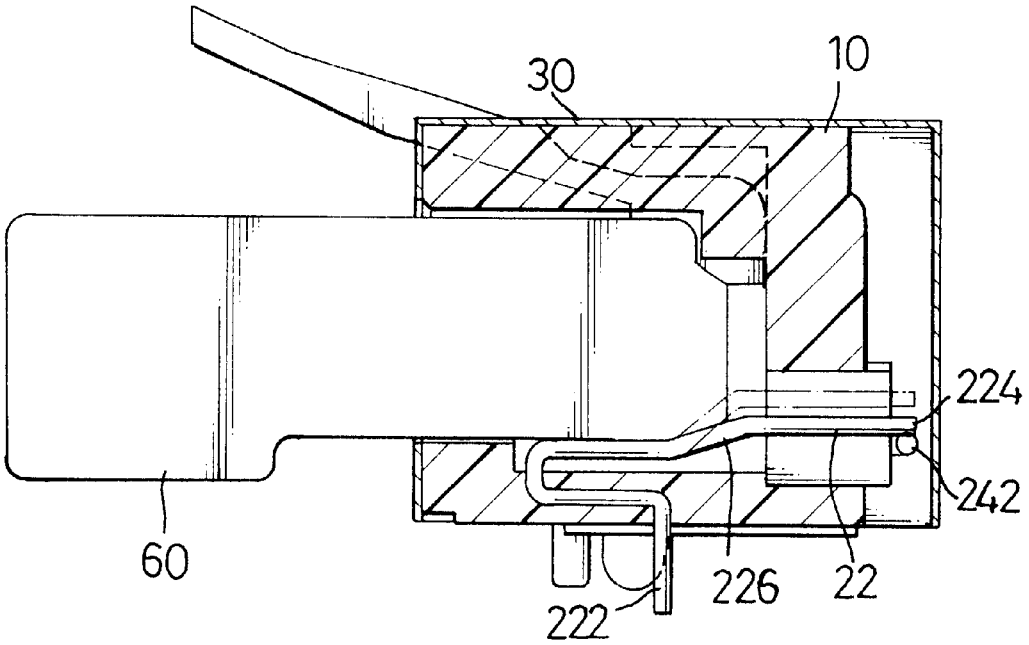
FIG. 3 is an operational side plane view in partial section of the socket in FIG. 1 showing a modular plug connected to a telephone cord inserted into the socket.
Figure 4:
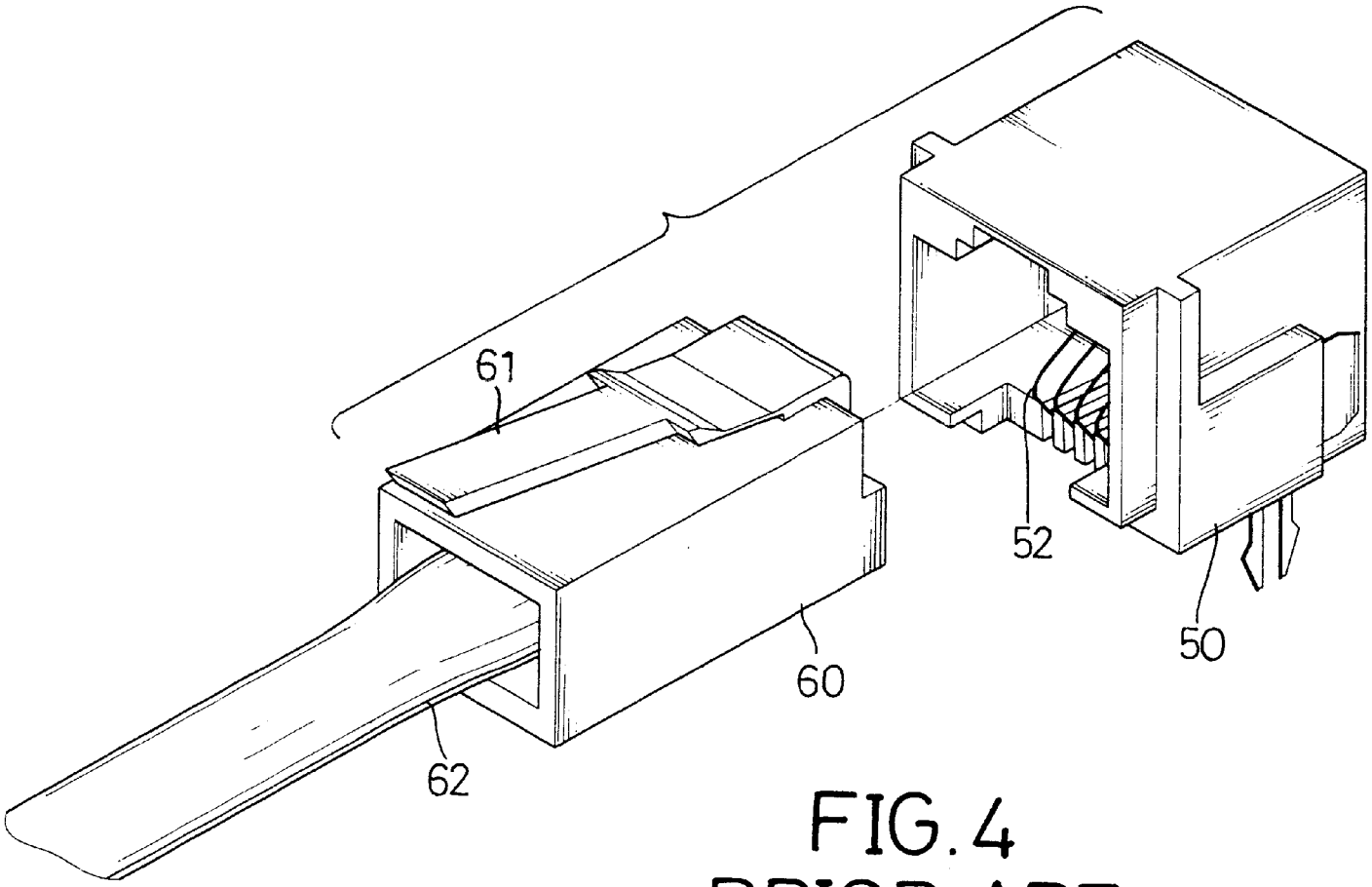
FIG. 4 PRIOR ART
FIG. 4 is an exploded perspective view of a modular plug connected to a telephone cord and a conventional modular socket in accordance with the prior art.

With reference to FIGS. 1 and 2, a socket in accordance with the present invention comprises a body (10), an enlarged pin (22), a detecting pin (24) and multiple contact pins (20). The body (10) is attached to a computer or a modem, A cavity (102) is defined in one side of the body (10). A locking hole (104) is defined in the top of the body (10) and communicates with the cavity (102). The enlarged pin (22) and the detecting pin (24) are separately secured in the cavity (102) of the body (10). A leg (222) is formed on a first end of the enlarged pin (22) and extends out from the body (10), and the detecting pin (24) also has a leg (not shown) on the first end, which extends out from the body (10). A lateral rod (242) is formed on the second end of the detecting pin (24) and extends to a position below the enlarged pin (22).

The contact pins (20) are secured in the cavity (102) of the body (10) in a row between the enlarged pin (22) and the detecting pin (24). The number of the contact pins (20) is 8. The length of each contact pin (20) is shorter than the enlarged pin (22) and the detecting pin (24). Consequently, an enlarged section (224) is formed on the second end of the enlarged pin (22). The enlarged section (224) of the enlarged pin (22) faces the lateral rod (242) of the detecting pin (24), but none of the contact pins (20) faces the lateral rod (242). Each contact pin (20) has a leg (202) extending out from the body (10). The legs (202, 222) of the contact pins (20), the enlarged pin (22) and the detecting pin (24) are electrically connected to contacts on a circuit board in the computer or the modem. Accordingly, the pins (20, 22, 24) are electrically connected to the circuit board. In addition, an oblique section (226) is formed on the middle portion of the enlarged pin (22) to elevate the enlarged section (224) above the lateral rod (242) of the detecting pin (24). Each contact pin (20) has an oblique section (204) formed on the middle portion of the contact pin (20) and aligning with the oblique section (226) of the enlarged pin (22).

In addition, a metal casing (30) is mounted around the body (10) to protect the body (10) and enhance the structural strength of the socket.

Figure 5:
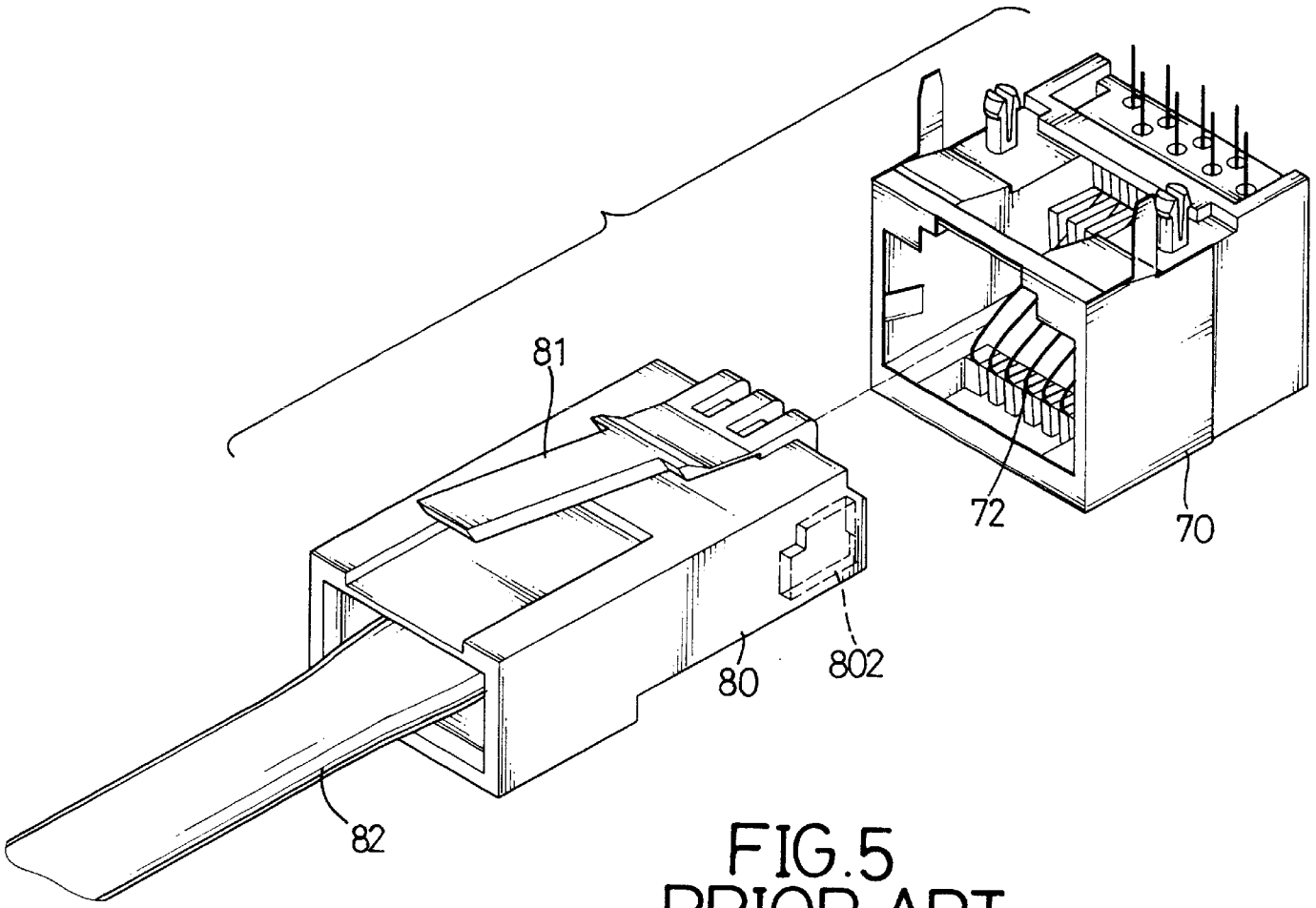
FIG.5 PRIOR ART
FIG. 5 is an exploded perspective view of a modular plug connected to a cable and a conventional modular socket in accordance with the prior art.

In use, with reference to FIGS. 1, 2 and 5, when a plug (80) with a cable (82) is inserted into the cavity (102) in the body (10), the locking piece (81) on the plug (80) will lock with the locking hole (104) in the body (10). The pins on the plug (80) will match all of the contact pins (20) in the body (10). The computer or the modem with the modular communications socket in accordance with the present invention can be connected to another computer or modem with the cable (82). The data in the computers can be transmitted through the pins (20) in the socket and the plug. In general, because the plug (80) with the cable (82) always has two recesses (802) defined in the bottom of the plug (80), the enlarged pin (22) and the detecting pin (24) will be received in the recess (802) in the plug (80). The enlarged pin (22) will not move when the plug is inserted into the socket. The enlarged section (224) of the enlarged pin (22) will not make contact with the lateral rod (242) of the detecting pin (24). The computer can distinguish that the plug (80) is connected with a cable (82) based on the open circuit between the enlarged pin (22) and the detecting pin (24) with a desired computer program. The computer program will transmit the data with a control module that fits with the cable (80).

With reference to FIGS. 1 to 4, when a plug (60) attached to a telephone cord (62) is inserted into the modular communications socket in accordance with the present invention, the locking piece (61) on the plug (60) will lock with the locking hole (104) in the body (10) because the locking piece (61) on the plug (60) has a structure similar to that of the locking piece on the plug with a cable. Some of the contact pins (20), 2, 4 or 6, will match with the pins on the plug (60). The plug body will push against the oblique sections (204) of the Contact pins (20) that do not contact with the pins on the plug (20) to bend downward. In the mean time, because there is no recess defined in the plug (60) with a telephone cord (62), the plug (60) also pushes against the oblique section (226) of the enlarged pin (26). The enlarged section (224) of the enlarged pin (22) will contact the lateral rod (242) of the detecting pin (24). Accordingly, the computer can determine that the plug (60) is connected to a telephone cord (62) based on the closed circuit between the enlarged pin (22) and the detecting pin (24) with a computer program. The computer program will transform the control module for transmitting data to use the telephone cord (62). Consequently, the computer can transmit data to another computer through a telephone cord (62) with the same socket. The socket can used with different types of communications plugs. The use of the socket becomes more versatile. The cost for manufacturing the computer or a modem capable of communicating via different media is reduced.

Even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A socket, comprising:

an insulated body having a cavity defined in a side of the body and a locking hole defined in a top of the body to communicate with the cavity;

an enlarged pin secured in the cavity of the body;

a detecting pin secured in the cavity of the body; and multiple contact pins secured in the cavity of the body in a row between the enlarged pin and the detecting pin, wherein a first leg is formed on a first and of the enlarged pin and extends outwardly and downwardly from the body;

each of said contact pins is shorter than either the enlarged pin or the detecting pin;

an enlarged section is formed on a second end of the enlarged pin;

a second leg is formed on a first end of the detecting pin and extends outwardly and downwardly from the body;

a lateral rod is formed on a second end of the detecting pin and extends across said second cad of said contact pins and to a position below the enlarged section of the enlarged pin; and a third leg is formed on a first end of each of said contact pins and extends outwardly and downwardly from the body;

whereby the legs of the contact pins, the enlarged pin and said detecting pin are adapted to be electrically connected to contacts on a circuit board, wherein an oblique section is formed on a middle portion of the enlarged pin to elevate the enlarged section above the lateral rod of the detecting pin, and wherein the lateral rod engages the enlarged pin when a mating plug is inserted in the cavity.

2. The socket as claimed in claim 1, wherein an oblique section is formed on a middle portion of each contact pin and aligns with the oblique section of the enlarged pin to elevate a second end of each contact pin up to the lateral rod of the detecting pin.

3. The socket as claimed in claim 1, wherein the number of the contact pins is 8.

4. The socket as claimed in claim 1 further comprising a metal casing mounted around the body to protect the body and to enhance a structural strength of the socket.

* * * * *